United States Patent [19]

Kondo et al.

[11] 4,186,362

[45] Jan. 29, 1980

[54] SWITCH

[75] Inventors: Mikio Kondo; Tadashi Yoshimura, both of Tsu, Japan

[73] Assignee: Matsushita Electric Works, Ltd., Osaka, Japan

[21] Appl. No.: 810,847

[22] Filed: Jun. 28, 1977

[30] Foreign Application Priority Data

Jun. 29, 1976 [JP] Japan ..... 51/77638

[51] Int. Cl.[2] ..... H01H 9/00

[52] U.S. Cl. ..... 335/205; 335/207

[58] Field of Search ..... 335/205, 206, 207

[56] References Cited

U.S. PATENT DOCUMENTS

| | | | |
|---|---|---|---|
| 3,261,944 | 7/1966 | Sherwood | 335/205 |
| 3,559,124 | 1/1971 | Posey | 335/205 |
| 3,720,895 | 3/1973 | Shlesinger et al. | 335/205 |
| 4,072,917 | 2/1978 | Haag et al. | 335/205 |

*Primary Examiner*—George Harris

*Attorney, Agent, or Firm*—Burns, Doane, Swecker & Mathis

[57] ABSTRACT

A switch employing such magneto-sensitive switching element as, for example, reed switch or the like and generally used for crime prevention purpose with a high reliability, wherein the switching element is initially set in either one of its ON and OFF states by a permanent magnet disposed adjacent the element and rotatably about its central axis perpendicular to its longitudinal axis and such initially set state of the element is turned to the other state to actuate an alarm device when another permanent magnet mounted, for example, to a door approaches the rotatable magnet and magnetically varies initial relationship of the rotatable magnet to the element.

9 Claims, 16 Drawing Figures

SWITCH

This invention relates generally to switches and, more particularly, to improvements in switches of the type in which magneto-sensitive switching element is made ON and OFF by permanent magnet for use in crime preventive devices.

There have been suggested various types of the switches of the kind referred to in, for example, U.S. Pat. Nos. 2,886,870, 3,161,742, 3,114,809, 3,155,792, 3,164,698, 3,164,696, 3,087,030 and the like. As other examples, further, switches of such structures as shown in FIGS. 1 and 2 have been used. As seen in the drawings, in the case of FIG. 1, a permanent magnet M mounted to a door and such a magneto-sensitive switching element SW as reed switch fixed to a pillar or wall to which the door is mounted are opposed in close relationship to each other so that the element SW will be substantially fully within the magnetic fluxes of the magnet M and thereby the element SW is held in its ON state to actuate an alarm buzzer BZ inserted between an electric power source E and an end terminal of the element SW and, when the magnet M is moved away from the element SW, the latter is turned to its OFF state, whereby an alarm buzzer BZ is deenergized. In order to have the buzzer BZ actuated even when signal lines L between the switching element SW and the buzzer BZ and source E are cut in such crime preventive device as above, as shown in FIG. 2, the element SW is retained in its ON state by means of a biasing permanent magnet $M_1$ secured adjacent the element SW in mutual axially parallel relation so as to enclose respective contact reeds of the element within the fluxes and a relay X is thereby actuated to deenergize the alarm buzzer BZ, whereas the permanent magnet M on the door brought into close relation to the biasing magnet $M_1$ causes the magnetic fluxes of the both magnets $M_1$ and M coupled directly to respective S poles from their N poles opposing each other so that the fluxes will pass substantially in vertical directions with respect to the contact reeds and thus with a less amount and thereby the element SW is turned to its OFF state to deenergize the relay X and energize the buzzer BZ. When the signal lines L are cut in the state where the element SW is ON, therefore, the relay X is deenergized and in turn the buzzer BZ is energized.

In the above described examples, on the other hand, it is necessary to utilize a magnet having a larger magnetic force as the magnet M mounted to the door for actuating the switching element SW so that magnetically operative distance between the magnet M and the element SW through which the latter may be positively actuated responsive to approaching and separating movements of the door can be made larger and thereby the switch can be operated reliably even in the case when fitting condition of the door to the entrance is poor, but the operative distance is practically limited to be about 20 mm. In the event when the door to which the magnet M is mounted is of such magnetic material as iron or the like, further, effective magnetic fluxes for actuating the switching element SW will become less due to that a main magnetic path is formed through such door of magnetic material, whereby the operative distance is caused to be shorter and the permanent magnet M of higher magnetic force cannot be used advantageously for actuating the switching element SW. The present invention has been suggested to solve such problems as disclosed above in the conventional switches of the kind referred to.

Primary object of the present invention is, therefore, to provide a switch that performs reliable operations.

Another object of the present invention is to provide a switch of a larger operative distance.

A further object of the present invention is to provide a switch that can be used reliably even in association with a door made of iron.

A further related object of the present invention is to provide a switch which is adaptable to differently functional usages with substantially the same arrangement of componential elements.

Other objects and advantages of the present invention shall become clear upon the following disclosures of the invention advance as detailed with reference to accompanying drawings, in which.

Figure 1:
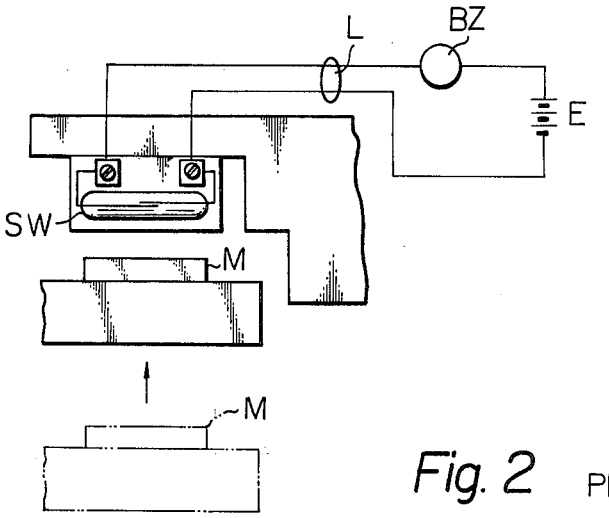
Fig. 1 PRIOR ART
FIGS. 1 and 2 are schematic views showing two exemplary types of conventional switch with an associated alarming circuit.
Figure 2:
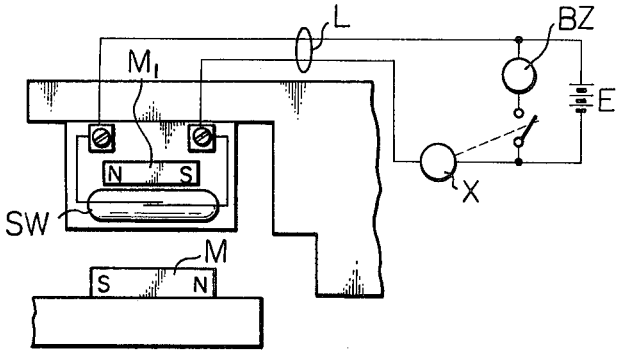
Fig. 2 PRIOR ART

While the present invention shall now be explained with reference to its preferred embodiments as shown in the drawings, it should be understood that the intention is not to limit the invention to the particular embodiments only but is to rather include all other modifications, alterations and equivalent arrangements possible within the scope of the appended claims.

Figure 3:
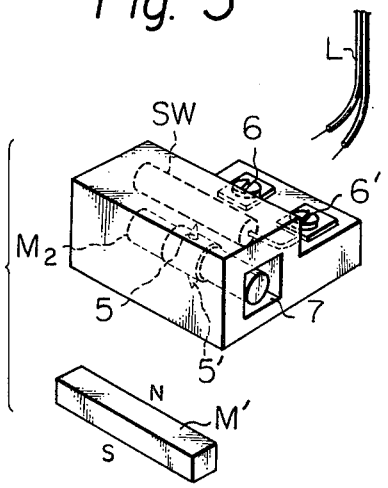
FIG. 3 is a perspective view showing respective component elements for an embodiment of the switch according to the present invention.
Figure 4:
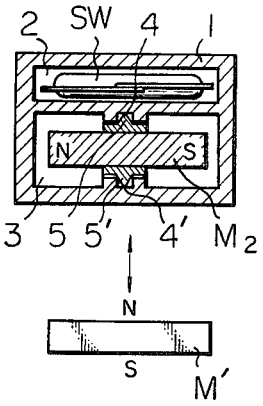
FIG. 4 is a vertical section of the switch shown in FIG. 3.

Referring to FIGS. 3 and 4, a housing 1 made of such non-magnetic material as a synthetic resin or the like is formed to have therein two chambers 2 and 3 isolated from each other in the vertical direction, the chamber 2 houses therein a reed switch SW as a magneto-sensitive switching element which is fixed to the housing 1 and the other chamber 3 accommodates a permanent magnet $M_2$ of a columnar shape in the present instance in a rotatable manner in such that vertically opposing shaft bearings 4 and 4' formed in the chamber 3 will bear respective rotary shaft projections 5 and 5' provided at the center of the magnet $M_2$ along an axis vertical with respect to longitudinal axis of the columnar shape magnet $M_2$ so as to allow the magnet to rotate about the projections 5 and 5'. The chamber 3 is made to be of dimensions enough for allowing the magnet $M_2$ to a certain extent from its position substantially in alignment at the longitudinal axis with extending directions of contact reeds of the reed switch SW for magnetically causing the reeds closed, to its rotated position enough for causing the reeds opened.

In the above arrangement, it is preferable that the rotary shaft projections 5 and 5' of the rotatable magnet $M_2$ are positioned vertically below (or even above) contacting center of the contact reeds in the reed switch SW so that both end weights of the columnar magnet $M_2$ can be balanced so as to be freely rotatable about the projections 5 and 5' and at the same time the respective reeds of the switch SW will be sufficiently exposed to the magnetic fluxes from the magnet $M_2$ when the magnet $M_2$ is in the aligned position with the reeds. The reeds of the switch SW are connected to respective terminals 6 and 6' to which respective signal lines L are connected. The housing 1 is provided with an aperture 7 for allowing pivoting state of the rotatable magnet $M_2$ inside the chamber 3 to be visible from outside.

Figure 5:
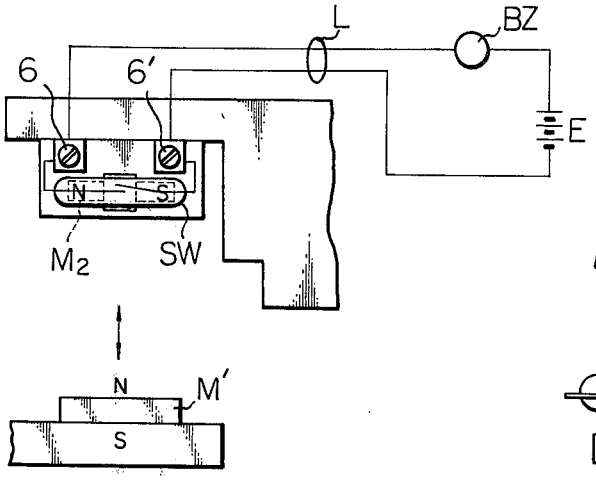
FIG. 5 is a schematic view of the switch of FIG. 3 with an associated alarming circuit.

Referring next to FIG. 5 which schematically show in plan view the switch body of FIGS. 3 and 4 with an associated alarming circuit, the reed switch SW is connected through the terminals 6 and 6' and lines L to an alarm buzzer BZ and electric power source E in series, so that the switch SW is made ON by the rotatable magnet $M_2$ which is in the aligned position with the reeds of the switch SW due to magnetic influence between them. Another permanent magnet M' of a bar shape and magnetized to have N pole on one main surface and S pole on the opposite surface is mounted to a door of which opening and closing movements are to be detected by the switch device so that the N pole surface of the magnet M' will oppose the rotatable magnet $M_2$ when the door with the magnet M' is brought close to the switch body of the switch SW and rotatable magnet $M_2$.

The operation of the embodiment shown in FIGS. 3 to 5 of the present invention shall now be explained with reference to FIGS. 6 and 7 which show the main components of the embodiment schematically.

Figure 6:
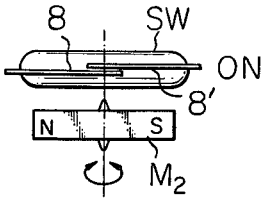
FIGS. 6 and 7 are explanatory views for the operation of the embodiment of FIG. 3.

In FIG. 6, the permanent magnet M' mounted to the door is not shown here since in the present instance the door is supposed to be in its position of opening the house entrance and remote enough from the switch device which is fixed to a pillar or wall adjacent the entrance for not influencing magnetically the rotatable magnet $M_2$. In this state, the rotatable magnet $M_2$ rotates to its position where its longitudinal axis coincides with the longitudinal directions of the respective reeds 8 and 8' of the switch SW which are of a magnetic material in close relation to the magnet $M_2$ so that magnetic fluxes of the magnet $M_2$ will be coupled through the reeds as a magnetic path, whereby the reeds 8 and 8' contact each other. Thus, the reed switch SW is in the ON state in this illustration. Due to this ON state, the alarm buzzer BZ is energized by the power source E to generate an alarm sound.

Figure 7:
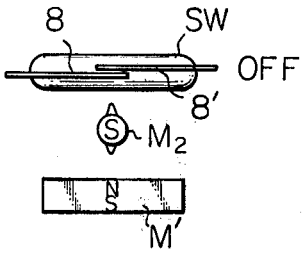

FIG. 7 shows a state in which the door is closed and the magnet M' mounted to the door is in close position to the reed switch SW and rotatable magnet $M_2$ enough for magnetically influencing the rotatable magnet $M_2$, so that the rotatable magnet $M_2$ will be rotated until its longitudinal axis is in transversing relation (as exaggerated for explaining purpose) to the longitudinal directions of the reeds 8 and 8', whereby the fluxes passing through these reeds become the smallest and the switch SW is caused to be turned to its OFF state to deenergize the alarm buzzer BZ.

As above, the permanent magnet $M_2$ associated with the magneto-sensitive reed switch SW for driving the latter to its ON or OFF state is supported to be freely rotatable about the rotary shaft projections 5 and 5' even with a small torque. Therefore, the rotatable magnet $M_2$ is enabled to rotate easily even with a small amount of magnetic fluxes and the operative distance is made shorter by the rotatability, whereby the reed switch SW is caused to be sufficiently driven even when the actuating permanent magnet M' is remote from the permanent magnet $M_2$ and a switch having a large operative distance as the crime preventive switch can be obtained.

Further, if the reed switch SW is mounted on the side of the door mounting member as housed in the housing together with the rotatable permanent magnet $M_2$, the ON and OFF operations of the reed switch SW can be performed even when a door made of iron is used.

Figure 8:
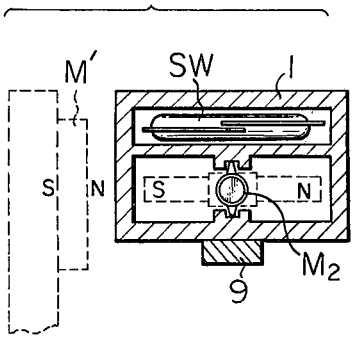
FIGS. 8 through 12 show respectively another embodiments of the present invention.

FIG. 8 shows another embodiment of the present invention, in which an auxiliary magnet 9 is provided in the direction perpendicular to the plane of the drawing and below the rotary shaft of the permanent magnet $M_2$. In this case, the permanent magnet $M_2$ is caused by the auxiliary magnet 9 to shift in the direction perpendicular to the drawing plane with its N and S poles and is stabilized there, so that the reeds of the reed switch SW are opened to be in OFF state. In this state, the permanent magnet $M_2$ is caused to be rotated by the approach of the actuating permanent magnet M' to the switch body of this arrangement, whereby the reeds of the reed switch SW are closed to be in ON state. With this switch, a switch in which the reed switch is of normally OFF state can be obtained.

Figure 9:
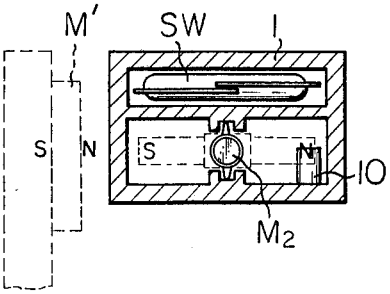

FIG. 9 shows a further embodiment of the present invention, in which a stopper 10 for restricting rotating extent of the permanent magnet $M_2$ is provided so as to project inside the housing adjacent the permanent magnet $M_2$ which rotates in response to the approach and separation of the actuating magnetic body M'. With this provision, it is prevented from occurring that the rotatable permanent magnet $M_2$ rotates abnormally and thereby accurate detection cannot be performed, in an event when an especially strong magnet other than the actuating magnetic body M' is used.

Figure 10:
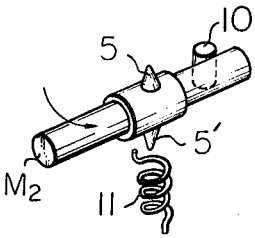

FIG. 10 shows another embodiment of the present invention, wherein a resetting spring 11 is provided together with the stopper 10 shown in the embodiment of FIG. 9, so that the stopper 10 will be made to be the one for setting initial position of the permanent magnet $M_2$ and the magnet will be reset to its initial position by the resetting spring 11.

Figure 11:
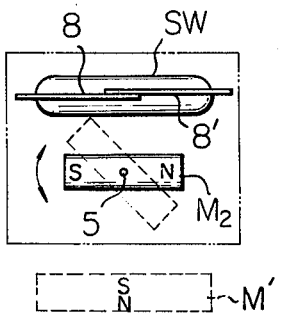

FIG. 11 shows a further embodiment of the present invention, which is of such a structure that the reed switch SW and rotatable permanent magnet $M_2$ are disposed on the same plane and the permanent magnet $M_2$ is provided to be rotatable on the horizontal plane about the rotary shaft 5, and the actuating permanent magnet M' is caused to be close to and remote from the permanent magnet $M_2$. Its operation is the same as in the case of FIG. 3 before described.

Figure 12:
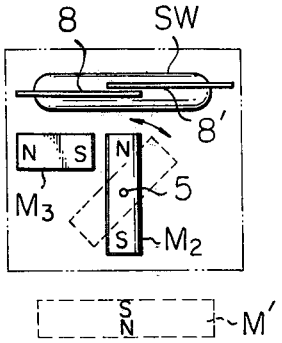

FIG. 12 shows another embodiment of the present invention, in which the reed switch SW and permanent magnet $M_2$ are disposed on the same plane, as in the case of FIG. 11, and the permanent magnet $M_2$ is provided to be rotatable on the horizontal plane about the rotary shaft 5. Further, the permanent magnet $M_2$ is disposed so as to be at right angles with respect to the reeds 8 and 8' of the reed switch SW by means of an auxiliary magnet $M_3$, whereby the reed switch is made to be normally in OFF state.

Figure 13A:
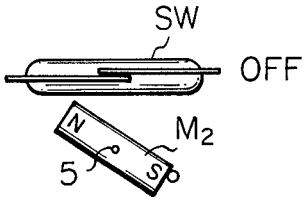
FIGS. 13A and 13B and FIGS. 13C and 13D show a further embodiment of the present invention in which the switch of the same structure is used for achieving different functions.
Figure 13B:
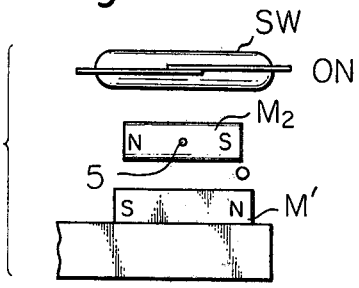
Figure 13C:
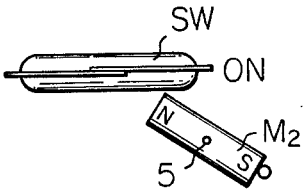
Figure 13D:
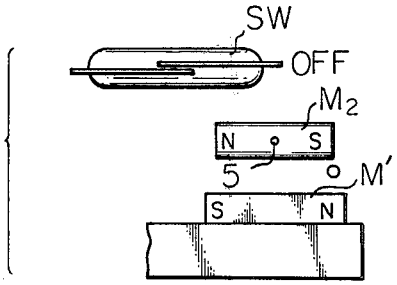

As will be understood in view of the respective embodiments in the foregoing, the switch body according to the present invention can be used as either one of the normally ON state type and normally OFF state type, but different arrangements of the respective components or uses of some other elements for adapting the switch body to such respective types have been referred to in these embodiments. According to the present invention, however, it is possible to adapt the switch body to each of the normally ON and normally OFF types with the switch body of the same arrangement of the same components. Yet further embodiment suggested for such purpose is shown in FIGS. 13A through 13D, in which FIGS. 13A and 13B show the case adapted to the normally OFF type and FIGS. 13C and 13D show the other case adapted to the normally ON type of the particular embodiment, respectively. A difference between the both cases is that the central line which passing through contacting center of the respective reeds of the reed switch SW at right angles with respect to longitudinal directions of the reeds and the axial line of the rotary shaft of the rotatable permanent magnet $M_2$ are in alignment with each other in the case of FIGS. 13A and 13B, whereas these two lines are deviated from each other in the case of FIGS. 13C and 13D.

In the case of the normally OFF type of FIGS. 13A and 13B, the rotary axis of the rotatable magnet $M_2$ is positioned to be aligned with the contacting center line of the reed switch SW as described above. In the drawings, the rotatable magnet $M_2$ is made to have N pole at the left end and S pole at right end, whereas the actuating magnet M' mounted to the door is made to be of reverse polarity as seen in FIG. 13B which shows a state in which the door and magnet M' are close to the switch SW and magnet $M_2$. A stopper is provided adjacent, for example, the S pole end of the magnet $M_2$ for restricting its rotation to a certain extent. As shown in FIG. 13A, when the actuating magnet M' on the door is remote from the rotatable magnet $M_2$, the latter is out of the magnetic influence of the former and rotated due to the influence of the reed switch only so that, for example, the N pole side of the magnet $M_2$ will be attracted towards the reed switch. In this case, the reed switch is exposed only to the fluxes around the N pole of the magnet $M_2$ so that the entire reeds of the switch will receive a smaller amount of the fluxes, whereby the switch is opened to be in the OFF state. As the door is closed and, as shown in FIG. 13B, the actuating magnet M' approaches the rotatable magnet $M_2$ so as to be parallel to the longitudinal directions of the reeds of the switch, the magnet $M_2$ is rotated to a position in which the same is parallel to the reeds and magnet M' due to the influence of the fluxes from the magnet M', whereby the reeds are fully exposed to the fluxes of the magnet $M_2$ and are caused to contact each other to render the switch SW to be in the ON state.

In the case of the normally ON type as shown in FIGS. 13C and 13D, the rotary axis of the rotatable magnet $M_2$ is positioned to be remote from the contacting center line of the reed switch SW as described above and also the actuating magnet M' is disposed as deviated from the contacting center line so as to correspond to the position of the rotatable magnet $M_2$. When the actuating magnet M' is separated away in this arrangement, the magnet $M_2$ is rotated so as to approach at the N pole end to the switch SW. At this time, the contacting parts of the respective reeds of the switch are exposed to the most of the magnetic fluxes around the N pole and flowing therefrom radially towards the S pole end of the magnet $M_2$ so that the reeds exposed to such relatively larger amount of the fluxes as compared with the case of FIG. 13A are caused to contact each other to achieve the ON state. When the door is opened and the actuating magnet M' is brought to the position shown in FIG. 13D, the rotatable magnet $M_2$ is rotated due to the influence of the magnet M' into the parallel position with the reeds as described before, so that the fluxes will pass only through one of the reeds (righthand side in the drawing) and thereby the entire reeds which are exposed to a relatively smaller amount of fluxes are caused to separate from one another and the OFF state is achieved.

As above, the switch body shown in FIGS. 13A through 13D is capable of performing the different functions only with the positional variation of the rotary shaft of the rotatable magnet $M_2$ with respect to the reed switch, or vice versa, and it is advantageous to render at least the rotary shaft of the rotatable magnet $M_2$ to be selectively shiftable between the two positions of the alignment and non-alignment relations to the reed contacting center at the time when the respective components are assembled.

While the foregoing embodiments have been referred to only with the use of the reed switch as the magneto-sensitive element, it is possible to employ a Hall element instead of the reed switch, in which case a Hall IC device including the Hall element as associated with an amplifier, trigger circuit, voltage stabilizing circuit, output circuit and the like on a single tip may be employed. When such Hall IC device is employed, further, such a partial modification of the foregoing arrangements that an auxiliary magnet is used, the rotatable magnet $M_2$ is formed into a U-shape, or the like is made for the purpose of precisely positioning the device within the magnetic fluxes from the rotatable magnet $M_2$.

What is claimed is:

1. A switch for detecting separation between first and second relatively movable parts, comprising:

a housing mounted on one of said parts;

a magneto-sensitive switching element mounted in said housing and movable between on and off positions, a rotatable permanent magnet mounted in said housing adjacent said switching element for actuating the latter, said rotatable permanent magnet being mounted for rotation about a fixed vertical axis located intermediate the ends of said rotatable permanent magnet; and an actuating means mounted on the other of said parts for establishing a magnetic field which causes rotation of said rotatable permanent magnet.

2. A switch according to claim 1, wherein said one of said relatively movable parts is a door frame and said other of said relatively movable parts is a door.

3. A switch according to claim 1, wherein said housing defines a first compartment containing said switching element and a second compartment containing said permanent magnet.

4. A switch according to claim 1 wherein said magneto-sensitive switching element is disposed substantially on the same plane as a rotating plane of said rotatable permanent magnet.

5. A switch according to claim 1 wherein said magneto-sensitive element is disposed above a rotating axis of said rotatable permanent magnet.

6. A switch according to claim 1 wherein said means element is a permanent magnet.

7. A switch according to claim 1 wherein said magneto-sensitive switching element is a reed switch.

8. A switch according to claim 1 which further comprising a stopper provided adjacent said rotatable permanent magnet for restricting rotations of the magnet.

9. A switch according to claim 8 which further comprising a resetting spring for resetting said rotatable permanent magnet to a position of said stopper.

* * * * *